United States Patent [19]

Humphrey

[11] Patent Number: 4,989,531

[45] Date of Patent: Feb. 5, 1991

[54] TOWING RELEASE SYSTEM

[76] Inventor: Terrence P. Humphrey, 7 Wood La., Fairfax, Calif. 94930

[21] Appl. No.: 395,330

[22] Filed: Aug. 17, 1989

[51] Int. Cl.[5] ....., A63C 15/00

[52] U.S. Cl. ..... 114/249; 24/230.5 R; 114/253; 441/65; 441/69

[58] Field of Search ..... 114/253; 441/65, 69, 441/79; 440/34; 294/82.24, 82.35; 24/230.5 R

[56] References Cited

U.S. PATENT DOCUMENTS

| | | | |
|---|---|---|---|
| 2,946,305 | 7/1960 | Hill | 114/253 |
| 3,125,060 | 3/1964 | Leonard | 114/253 |
| 3,227,126 | 1/1966 | Etzlor | 441/69 |
| 3,604,388 | 9/1971 | Brown | 441/69 |
| 4,069,786 | 1/1978 | La Botz | 441/69 |
| 4,302,858 | 12/1981 | Casciano | 441/65 |

OTHER PUBLICATIONS

Mariners Annual 1983, by Charles Kerr Enterprises, Inc., p. 21.

*Primary Examiner*—Sherman Basinger
*Assistant Examiner*—Thomas J. Brahan
*Attorney, Agent, or Firm*—Larry D. Johnson

[57] ABSTRACT

A towing release system provides an improved user-actuated quick-release towing device for use in water sports, and comprises a wire bail member for installation into the leading edge of a water sports implement such as a kneeboard, and a separate receiver element for installation on the towline near the towline handle. The wire bail member includes a bar portion releasably engageable into a complementary rearward-oriented slot portion on the bottom side of the receiver element. Thus, the water sports implement rider can initially ride through the water without having to bear the pulling force of the towline, and can later release the receiver element connection from the wire bail member by manually pulling rearward and upward on the towline handle, to continue his ride in the traditional manner.

4 Claims, 2 Drawing Sheets

TOWING RELEASE SYSTEM

BACKGROUND OF THE INVENTION

1. Field of the Invention

This invention relates generally to towing cables, ropes and related apparatus, and more specifically to an improved quick-release mechanism to be utilized in conjunction with towlines, especially as used with water sports implements such as kneeboards.

2. Description of the Prior Art

Many water sports, such as water skiing and kneeboarding, utilize a towline and handle to pull the rider along the water surface behind a powerboat. For example, in the case of kneeboarding, the kneeboard rider is typically pulled from a stationary starting position floating in the water, with the rider lying prone upon the kneeboard and grasping the handle of the towline, thence up to a sufficient speed where the kneeboard and its rider are planing on top of the water surface. At this point, the kneeboard rider can pull himself up to a kneeling position on the kneeboard and continue his ride in the traditional manner.

However, due to the great water resistance encountered during this transitional pullout to planing speed, it can be difficult for such a kneeboard rider to manually hold onto the towline handle. In addition, once planing speed has been reached, the kneeboard rider must attempt to raise himself to the desired kneeling position on the kneeboard while simultaneously holding on to the towline handle against the pull of the boat, which can be very awkward to do. Furthermore, for safety and aesthetic reasons, it is inappropriate to simply permanently fasten the towline to the kneeboard.

SUMMARY OF THE INVENTION

The towing release system of this invention provides an improved quick-release device for use in water sports where a user-actuated towline release is desired. The release system comprises a wire bail member for permanent installation into the leading edge of a water sports implement such as a kneeboard, and a separate receiver element for installation onto the towline near the towline handle. The wire bail member includes a bar portion at its forward terminus, which bar portion is releasably engageable into a complementary rearward-oriented slot portion on the bottom side of the receiver element.

In use, the bar portion of the wire bail member in the leading edge of the water sports implement is brought into alignment with and captured by the receiver element slot. This engagement is sufficiently secure to transfer all of the pulling force of a powerboat and towline through the receiver element/wire bail member connection and directly to the leading edge of the water sports implement. Thus, the water sports implement and its rider are pulled through the water without the rider having to bear the pulling force that would otherwise be transferred through the towline handle to his arms, and he can take advantage of this opportunity, for example, to use his hands and arms to elevate himself to the desired kneeling position on the water sports implement when appropriate.

Once a planing speed has been reached, and the water sports implement rider has achieved a comfortable (e.g., kneeling) position, the rider can release the receiver element (on the towline) connection from the wire bail member (on the water sports implement) by manually pulling rearward and upward on the towline handle, thereby effectively moving the rearwardoriented slot portion on the bottom of the receiver element rearward and upward to disengage it from the bail member bar portion. This enables the rider to then manually assume the pulling force on the towline handle from the powerboat and towline, and continue his ride in the traditional manner.

A further desirable aspect of this inventive towing release system is the negligible effect its components have on the appearance and structural integrity of the water sports implement and towline to which they are installed. The wire bail member is installed into the leading edge of the water sports implement in such a manner that it does not deface the top or bottom of the implement, but rather merely extends a small wire "hook" or "loop" forward from the leading edge of the implement, which structure does not interfere with the implement's performance. Furthermore, the receiver element comprises a hollow cylinder with an internal diameter marginally greater than the diameter of the towline to which it is to be attached. The receiver element is installed on the towline by merely threading the towline through the receiver element, and is secured there by a simple knot formed in the towline on either side of the receiver element. Thus, the receiver element is captured between these two knots in the towline, and it does not at all interfere with the towline's function or strength.

DETAILED DESCRIPTION OF A PREFERRED EMBODIMENT

Figure 1:
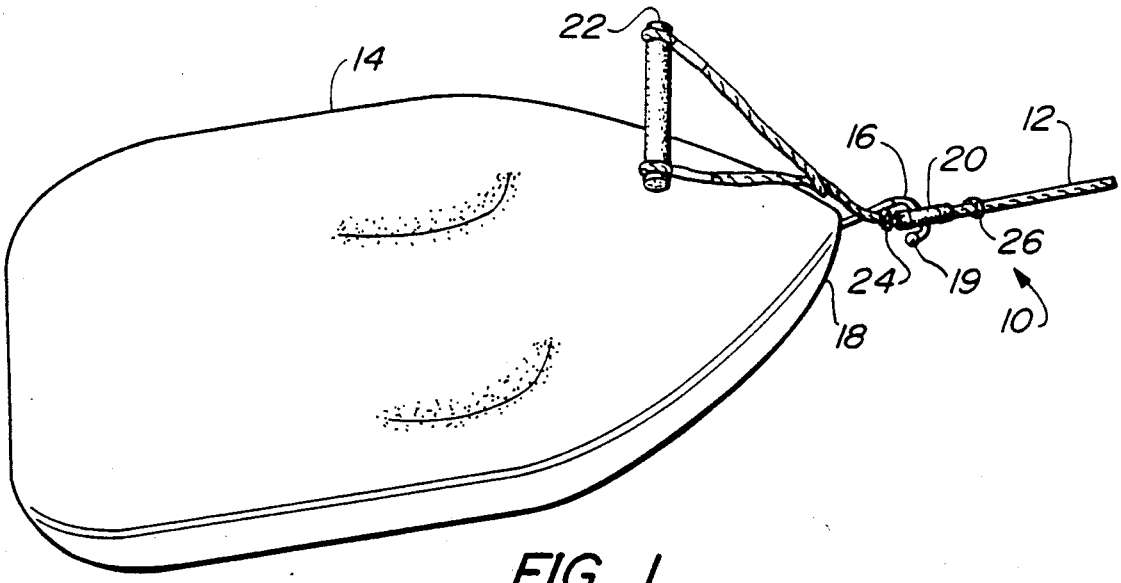
FIG. 1 is a perspective view of the towing release system of this invention in operation in its towing (connected) configuration for a towline and water sports implement, with the wire bail member installed into the leading edge of the water sports implement, and the receiver element installed on the towline.

FIG. 1 is a perspective view of the towing release system 10 of this invention in operation in its towing (connected) configuration for a towline 12 and water sports implement (such as a kneeboard) 14, with a wire bail member 16 installed into the front or leading edge 18 of the kneeboard, and a receiver element 20 installed on the towline proximate the towline handle 22. As can be seen in this view, wire bail member 16 is attached to receiver element 20, which itself is captured between a pair of knots 24, 26 formed in the towline 12. This figure illustrates a "hook" or open-end version of wire bail member 16, which preferably also includes a flared end or retainer 19 to prevent inadvertant lateral slippage of the bail member off of the receiver element.

Figure 2:
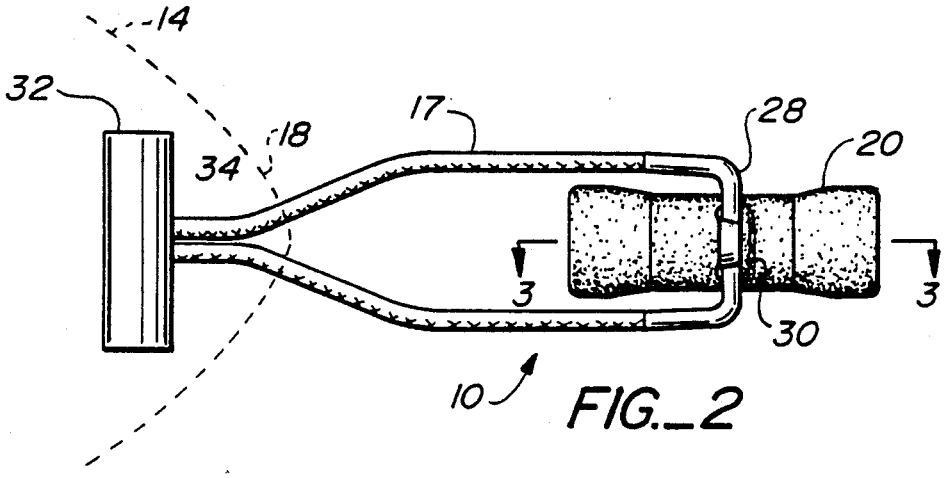
FIG. 2 is a bottom plan view of the towing release system of this invention illustrating the wire bail member installed into the leading edge of the water sports implement (shown in phantom), and the wire bail member bar portion engaged into the receiver element slot portion.

FIG. 2 is a bottom plan view of the towing release system 10 of this invention illustrating a closed-loop version wire bail member 17 installed into the water sports implement leading edge 18 (shown in phantom), and a bar portion 28 of wire bail member 17 engaged into a slot portion 30 of receiver element 20. Wire bail member 17 comprises a loop of stainless steel, plastic, or other rust and corrosion-resistant material, and is secured to water sports implement 14 by insertion of bail anchor 32. In the preferred embodiment, bail anchor 32 pivots about its connection 34 with bail member 17, and is installed by simply drilling a hole in the tip of leading edge 18 of a diameter marginally greater than the diameter of anchor 32, inserting the anchor in to the leading edge lengthwise, and pivoting the anchor at its connection 34 so that it is turned laterally with respect to the leading edge (much as in the installation of an anchor bolt).

Figure 3:
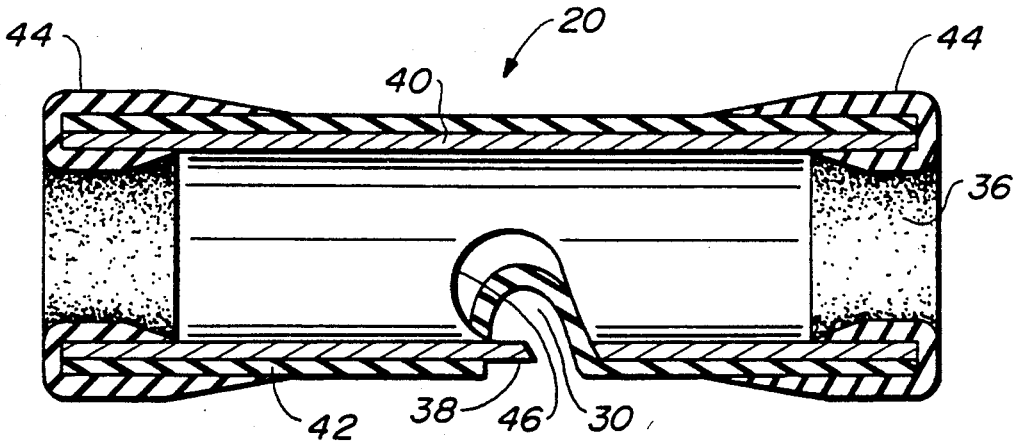
FIG. 3 is a side elevation cross-sectional view of the receiver element of the towing release system of this invention, illustrating the hollow bore, rearward-oriented slot portion, and tooth member of the receiver element, this view taken along line 3—3 of FIG. 2.

FIG. 3 is a side elevation cross-sectional view of the receiver element 20 of the towing release system of this invention, illustrating a hollow bore 36, the rearward-oriented slot portion 30, and a tooth member 38 of the receiver element, this view taken along line 3—3 of FIG. 2. Receiver element 20 comprises a hollow tube or cylinder 40 of a diameter slightly greater than the towline to which it is to be attached (e.g., one-half inch), and of a length to provide a stable positioning on the towline (e.g., two to three inches long). Like the wire bail member, it is preferably made of corrosion resistant material such as stainless steel, and may be covered by a plastic or rubber sheath 42 and end caps 44. Sheath 42 can assist in the secure capture of the wire bail member by providing a high coefficient of friction surface against the bail member bar portion.

Slot portion 30 presents a rearward-oriented cavity in the bottom side of receiver element 20, as partially defined by tooth member 38. This cavity is so oriented to securely capture the wire bail member bar portion and enable pulling of the water sports element by the towline, with the wire bail member bar portion contacting the rear surface 46 of the slot, and tooth member 38 preventing any inadvertent or premature release of the wire bail member.

Figure 4:
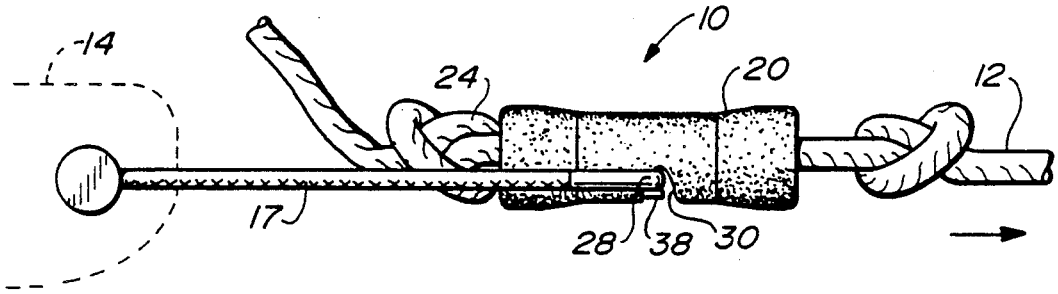
FIG. 4 is a side elevation view of the towing release system of this invention in operation in its towing (connected) configuration for a towline and water sports implement, illustrating the wire bail member bar portion captured by the receiver element slot portion.

FIG. 4 is a side elevation view of the towing release system 10 of this invention in operation in its towing (connected) configuration for a towline 12 and water sports implement 14, illustrating the wire bail member bar portion 28 captured by the receiver element slot portion 30. This view illustrates that during towing, receiver element 20 is forced back and held in place on the towline 12 (towards the water sports element and towline handle) by knot 24 which prevents receiver element 20 from movement down the towline, thus transferring the force of the pull to wire bail member 16 and water sports implement 14.

Figure 5:
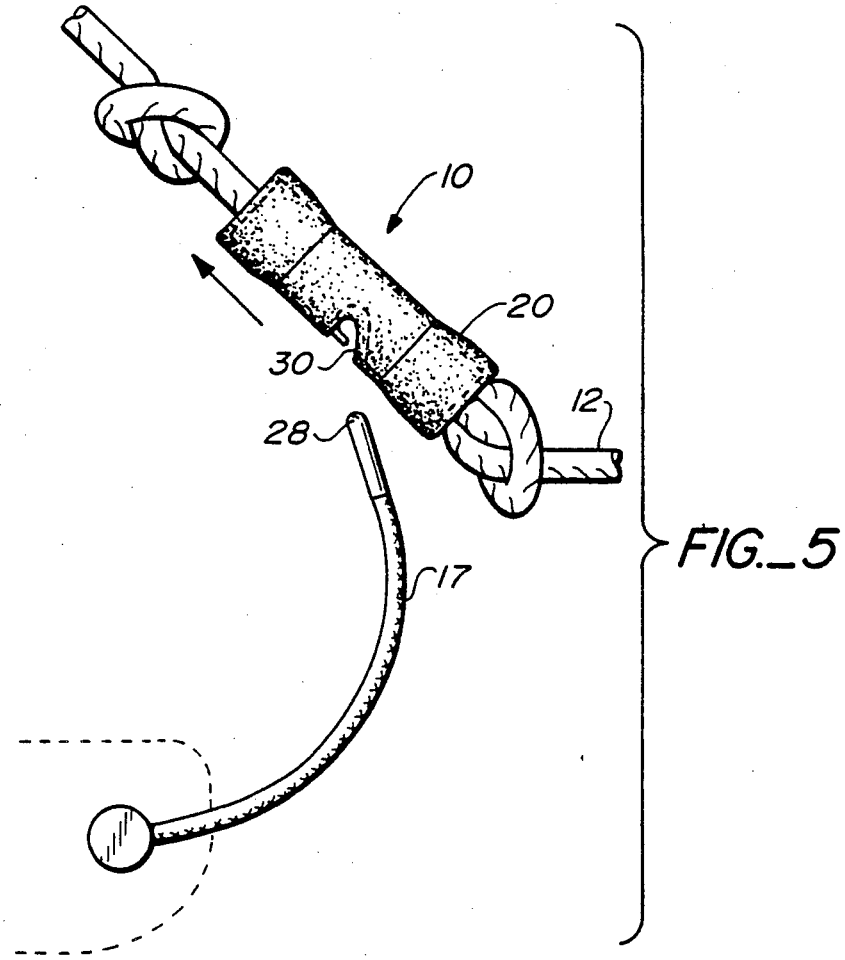
FIG. 5 is a side elevation view of the towing release system of this invention in operation in its released (disconnected) configuration, with the receiver element having moved upward in response to the user's pull, and the bail member bar portion released from capture by the receiver element slot portion.

FIG. 5 is a side elevation view of the towing release system 10 of this invention in operation in its released (disconnected) configuration, with the receiver element 20 having moved upward in response to the user's pull, and the bail member bar portion 28 released from capture by the receiver element slot portion 30. In this view, the user has pulled up on the handle end of towline 12, thereby elevating receiver element 20 and flexing wire bail member 17 (previously) captured therein, until receiver element 20 is moved upward and rearward to a point where bail member bar portion 28 slips out of engagement with receiver element slot portion 30. At this point, the bail member falls back to its original position, and the pull of the towline is transferred directly to the towing handle and the rider's arms.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What is claimed as invention is:

1. A towing release device for a towline attached to a boat, said towline used for pulling a rider utilizing a water sports implement and including a handle for grasping by said rider, said towline having a diameter, said release device comprising:

a bail member for secure attachment to said water sports implement, said bail member having a forward end forming a bar portion; and a receiver element for installation onto said towline proximate said towline handle, said receiver element comprising a hollow cylinder having an internal diameter marginally greater than said towline diameter, said hollow cylinder conditioned to be threaded by said towline and positioned on said towline by knots formed in said towline, said receiver element further having a rearward end and a slot portion conditioned for releasable engagement with said bail member bar portion, said slot portion comprising a rearward-oriented slot partially defined by a tooth member and extending through said hollow cylinder, wherein when said receiver element slot portion is engaged with said bail member bar portion, pulling force from said boat and towline is transmitted directly to said water sports implement, and when said receiver element slot portion is disengaged from said bail member bar portion, pulling force from said boat and towline is transmitted directly to said towline handle.

2. The towing release device of claim 1 wherein said water sports implement has a leading edge, and said bail member comprises a wire loop extending forward from said leading edge.

3. The towing release device of claim 2 wherein said wire bail member includes a rearward end forming a bail anchor, and said bail anchor is permanently secured into said water sports implement leading edge.

4. The towing release device of claim 1 wherein said receiver element includes a sheath portion providing a high friction surface against said bail member bar portion when said slot portion is engaged with said bar portion.

* * * * *